US008697429B2

(12) United States Patent
Sachdev

(10) Patent No.: US 8,697,429 B2
(45) Date of Patent: Apr. 15, 2014

(54) METHOD FOR DYEING A TEXTILE PRODUCT USING NEEM AND HOLY BASIL EXTRACT

(75) Inventor: Rajiv Rai Sachdev, New Delhi (IN)

(73) Assignee: Advantage Nature (a unit of Advantage Television Pvt. Ltd.), New Delhi (IN)

( * ) Notice: Subject to any disclaimer, the term of this patent is extended or adjusted under 35 U.S.C. 154(b) by 0 days.

(21) Appl. No.: 13/574,274

(22) PCT Filed: May 21, 2010

(86) PCT No.: PCT/IN2010/000345

§ 371 (c)(1), (2), (4) Date: Jul. 20, 2012

(87) PCT Pub. No.: WO2011/089615

PCT Pub. Date: Jul. 28, 2011

(65) Prior Publication Data

US 2012/0309077 A1 Dec. 6, 2012

(30) Foreign Application Priority Data

Jan. 21, 2010 (IN) ..... 114/DEL/2010

(51) Int. Cl.
*D06M 16/00* (2006.01)

(52) U.S. Cl.
USPC ..... 435/263; 8/490; 8/646

(58) Field of Classification Search
USPC ..... 8/490, 646; 435/263
See application file for complete search history.

(56) References Cited

U.S. PATENT DOCUMENTS

2009/0307852 A1* 12/2009 Sachdev ..... 8/490

FOREIGN PATENT DOCUMENTS

WO WO2006070402 A1 7/2006

OTHER PUBLICATIONS

Fatima N. et al. Dyeing of Silk with Natural Dye Extracted from Coleus Leaves. International Dyer 190(2)24-26, Mar. 1, 2005.*
International Search Report for PCT/IN2010/00345.

* cited by examiner

*Primary Examiner* — Ralph Gitomer
(74) *Attorney, Agent, or Firm* — Symbus Law Group, LLC; Clifford D. Hyra

(57) ABSTRACT

A process of preparing garments and natural textile products using natural fiber, yarns and fabric is provided. The process involves treating the natural textile products with natural dyes converted into micro-sized and nano-sized particles. The textile product is also treated with bio-enzymes and natural ingredients at all stages. A process of preparing garments using Neem (*Azadirachta Indica*) and Holy Basil (*Ocimum Sanctum* or *Tulsi*) is also provided.

20 Claims, 1 Drawing Sheet

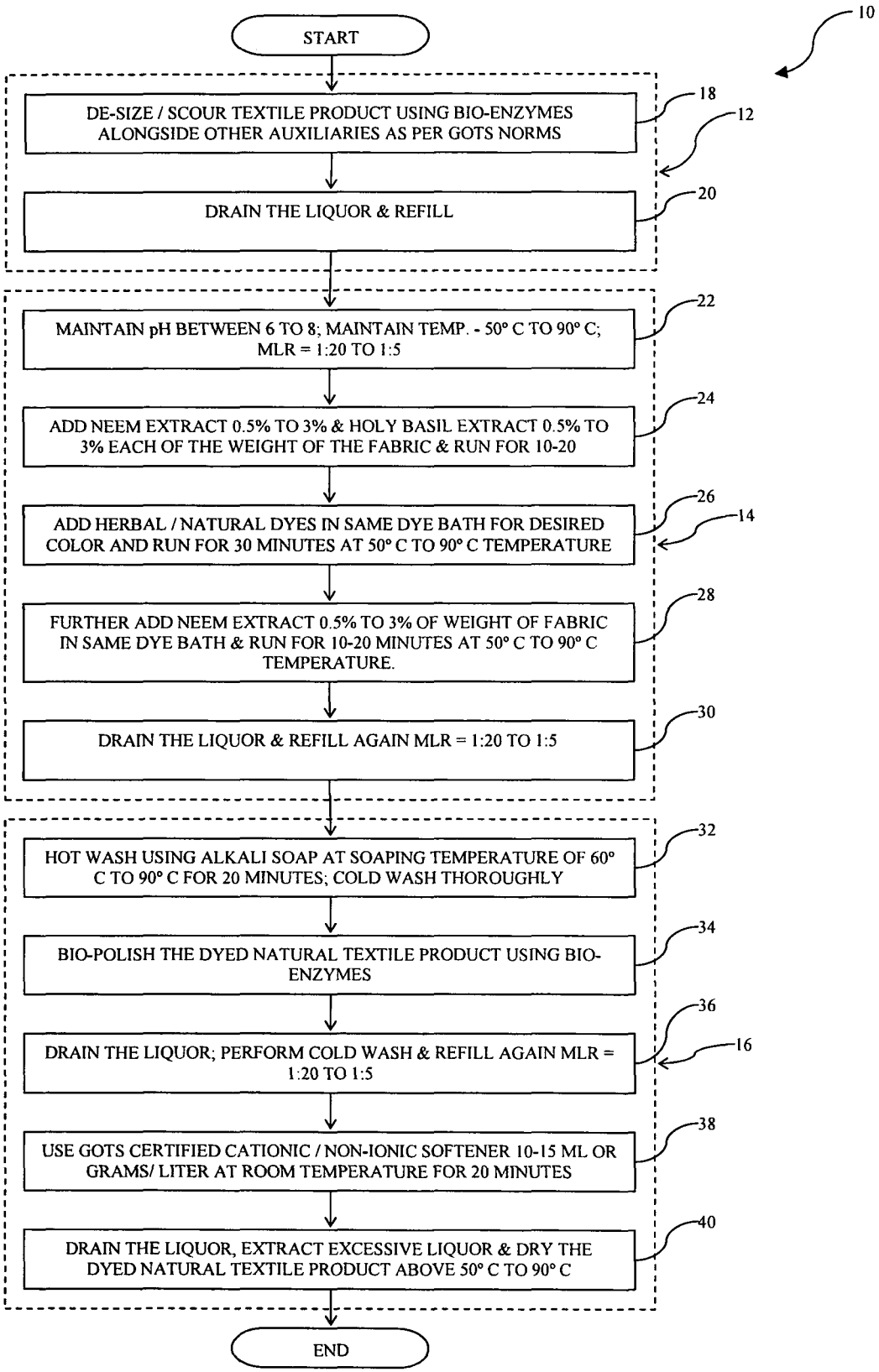
10
START
DE-SIZE / SCOUR TEXTILE PRODUCT USING BIO-ENZYMES ALONGSIDE OTHER AUXILIARIES AS PER GOTS NORMS
18
12
DRAIN THE LIQUOR & REFILL
20
MAINTAIN pH BETWEEN 6 TO 8; MAINTAIN TEMP. - 50° C TO 90° C; MLR = 1:20 TO 1:5
22
ADD NEEM EXTRACT 0.5% TO 3% & HOLY BASIL EXTRACT 0.5% TO 3% EACH OF THE WEIGHT OF THE FABRIC & RUN FOR 10-20
24
ADD HERBAL / NATURAL DYES IN SAME DYE BATH FOR DESIRED COLOR AND RUN FOR 30 MINUTES AT 50° C TO 90° C TEMPERATURE
26
14
FURTHER ADD NEEM EXTRACT 0.5% TO 3% OF WEIGHT OF FABRIC IN SAME DYE BATH & RUN FOR 10-20 MINUTES AT 50° C TO 90° C TEMPERATURE.
28
DRAIN THE LIQUOR & REFILL AGAIN MLR = 1:20 TO 1:5
30
HOT WASH USING ALKALI SOAP AT SOAPING TEMPERATURE OF 60° C TO 90° C FOR 20 MINUTES; COLD WASH THOROUGHLY
32
BIO-POLISH THE DYED NATURAL TEXTILE PRODUCT USING BIO-ENZYMES
34
DRAIN THE LIQUOR; PERFORM COLD WASH & REFILL AGAIN MLR = 1:20 TO 1:5
36
16
USE GOTS CERTIFIED CATIONIC / NON-IONIC SOFTENER 10-15 ML OR GRAMS/ LITER AT ROOM TEMPERATURE FOR 20 MINUTES
38
DRAIN THE LIQUOR, EXTRACT EXCESSIVE LIQUOR & DRY THE DYED NATURAL TEXTILE PRODUCT ABOVE 50° C TO 90° C
40
END

METHOD FOR DYEING A TEXTILE PRODUCT USING NEEM AND HOLY BASIL EXTRACT

This application claims benefit of Indian patent application No. 114/DEL/2010,filed May 21, 2010which is hereby incorporated by reference in its entirety.

TECHNICAL FIELD

The present invention generally relates to dyeing and processing of a textile material, and more particularly to the use of natural dyes alongside Neem (*Azadirachta Indica*) and Holy Basil (*Ocimum Sanctum* or *Tulsi*) in the process of dyeing.

BACKGROUND

Ever since man developed the art of weaving and knitting, the use of textile in the garments and clothing industry has remained on the forefront. While in the early days, textile was only made of fibers derived from natural sources, currently both natural as well as synthetic fibers are being used in making textile material. Regardless of the material used in making textile, dyeing of the textile material has its own importance and has evolved significantly over time.

While the earliest written record of dyeing dating back to 2600 BC has been found in China, it was only in the year 1856 that the world's first synthetic dye was discovered. Until this discovery, all dyes in use were obtained from natural substances or materials. Most colors obtained from natural sources were inconsistent and sometimes stronger with a high likelihood of fading out upon washing. Synthetic dyes on the other hand always produce a uniform shade. This is because the particle size of most natural dyes is quite large compared with those of synthetic dyes, which prevents deep enough penetration of the natural dyes into the textile material. Thus, this lack of uniformity in shades led to natural dyes being quickly replaced by the newer synthetic dyes.

Because of the increased usage of synthetic dyes, the benefits and therapeutic utility offered by natural fibers and natural dyes started getting ignored. It is well known that the garments and textile products made of natural fibers & dyes are not only eco-friendly but also beneficial for the health. However, as most of the currently known processes involved in treating fibers with natural dyes are quite cumbersome and time-consuming, there has been little or no incentive to use natural dyeing processes to the full benefit of the consumers.

There is therefore a need for efficient processes utilizing natural dyes for treating garments and textile for the purposes of coloring in order to exploit the full benefits of natural fibers and material. There is also a need for natural dyeing processes that help retain the colors firmly in the fibers for a much longer period of usage.

SUMMARY

The object of the present invention is to provide a process of preparing garments and natural textile products using natural fiber, yarns and fabric with natural dyes converted into micro-sized and nano-sized particles using nanotechnology and materials science applications while processing them with bio-enzymes and natural ingredients at all stages.

Another object of the present invention is to provide a process of preparing garments using Neem (*Azadirachta Indica*) and Holy Basil (*Ocimum Sanctum* or *Tulsi*), which have been extensively used in Ayurveda, Unani and Homoeopathic therapies.

BRIEF DESCRIPTION OF THE DRAWINGS

These and other features, aspects, and advantages of the present invention will become better understood when the following detailed description is read with reference to the accompanying drawing in which like characters represent like parts throughout the drawing, wherein:

FIG. 1 is a flow chart of an exemplary dyeing process, in accordance with aspects of the present techniques.

DETAILED DESCRIPTION OF EXEMPLARY EMBODIMENTS

In the following paragraphs, various methods involved in dyeing a textile material will be explained in detail. The approach described hereinafter provides the various steps involved in the pre-processing stage before the actual dyeing process and the steps involved in the post-processing stage. The approach is described with reference to a natural textile product made alone or from a combination of a fiber, yarn, fabric, or, garment derived from natural sources. These natural sources may include any one or a combination of any of the sources such as organic cotton, cotton, silk, wool, linen, hemp, bamboo, coconut palm, soya, milk, and the like. As will be appreciated by those of ordinary skill in the art, the techniques are equally applicable to materials derived from other natural sources. Indeed, the exemplary uses and implementations described herein are merely provided as examples to facilitate understanding of the presently contemplated techniques. Therefore, the various aspects of the present technique will be explained, by way of examples only, with the aid of figures hereinafter.

Referring generally to FIG. 1, the process will be described by reference to an exemplary process flowchart designated generally by numeral 10. It should be appreciated however, that the process 10 may find utility in a range of applications, and that its use in dyeing natural textile products described herein is but one such application. As will be understood, the process 10 may be employed in various kinds of applications ranging from simple dyeing of textile products to more complex coloring of natural or synthetic products, such as for example, hair, leather, and the like.

The process 10 shown in FIG. 1 can be broadly categorized into three stages of processing: pre-processing stage indicated by numeral 12, dyeing stage 14 and post-processing stage 16. In the pre-processing stage 12, the textile product is prepared for dyeing. During the dyeing stage 14, actual dyeing is performed on the pre-processed textile product using natural dyes extracted from herbs converted into micron-sized or nano-sized particles and bio-enzymes free from genetically modified organisms (GMO) or genetically engineered organisms (GEO) or, in other words, GMO free bio-enzymes. The textile material is then treated with purified extract of Neem (*Azadirachta Indica*) and Holy Basil (*Ocimum Sanctum* or *Tulsi*), which is converted into particles of mesh size less than about 400 so as to obtain the desired textile product. The dyed textile product is then subjected to the post-processing stage 16, which helps in enhancing the features of the dyed textile product, as will be described in greater detail below.

It may be noted that the raw material used for preparing the natural dyes are obtained from various parts of plants such as the roots, stem, bark, leaves, fruits, fruit rind and flowers.

Some of the plants that are used for preparing the dyes include *Acacia catechu, Acacia nilotica, Mallotus philippensis, Petrocarpus santanils, Punica garantum, Quercu infrctoria, Rheum emodi, Rubia cordifolia, Rumex maritmus, Terminalia chebula, Indigoferra tinctoria*, among others.

Each of the three stages is explained in further detail in the description below. In the pre-processing stage 12, the textile product is de-sized or scoured using bio-enzymes as indicated in step 18. During this step 18, the de-sizing and scouring may be performed alongside other auxiliaries that have been approved as per norms defined by the Global Organic Textile Standard (GOTS). The bio-enzymes used for de-sizing or scouring the natural textile product are GMO free enzymes depending on the nature of the textile product, as noted before. Some of the bio-enzymes used for the bio-polishing of the natural textile product are amylase, catalase, pectinase, cutinase, cellulase on cellulose, lipase on lipids, and protease on protein-based fibers, among other bio-enzymes. The liquor in which the de-sizing or scouring is performed is then drained and refilled, as noted in step 20. Thus, during the pre-processing stage 12, completed at step 18, the pre-processed textile product which is ready for dyeing in stage 14 is produced.

During the dyeing stage 14, a water-based solution with pH of about 6 to about 8 maintained at a temperature of about 50 degrees Celsius to about 90 degrees Celsius may be used, as shown in step 22. The Material Liquor Ratio (MLR) of the liquor may be maintained between 1:20 to 1:5. As shown in step 24, a herbal extract, such as of Neem and Holy Basil each with concentrations between about 0.5% to about 3% by weight of the textile product, is used to treat the textile product for a desirable period. In one embodiment, the extract may be used to treat the textile material for about 10 to 20 minutes. It may be noted that micro-encapsulation of certain natural aromas and fragrances may also be performed in step 24. For example, natural aromas and fragrances such as rose, lavender, chameli, jasmine, musk, or any combination of these or any other natural aromas and fragrances may be added along with the herbal extracts of Neem and Holy Basil. Such a micro-encapsulation will enhance and induce lasting aesthetic properties in the textile product. Similarly, coatings of herbal extracts or herbal concoctions of various medicinal plants such as Aloe Vera, lemon grass, gooseberry, or even bio-engineered solutions of Serecin or Chitosan converted into micron-sized and nano-sized particles may also be added along with the herbal extracts of Neem and Holy Basil. Again, it will be appreciated by one of ordinary skill in the art that other fragrant encapsulation/coatings or medicinal coatings may also be used to enhance different properties of the textile product. Once the textile material is treated with the extract of Neem and Holy Basil, natural or herbal dyes may be used to obtain the desired color shade, as shown in step 26. The natural or herbal dye is added in the same dye bath. As will be appreciated by those of ordinary skill in the art, to obtain desirable effects, the textile material may be treated in the dye bath for a suitable period of time at a suitable temperature, such as for example, about 30 minutes between about 50 degrees Celsius to about 90 degrees Celsius in one embodiment. It may however be noted that the textile material may be treated at a different temperature for a different amount of time as per the desired coloring shade required.

Once dyed, the textile material is again treated with an extract of Neem and Holy Basil each with concentrations between about 0.5% to about 3% by weight of the textile material, as shown in step 28. This step of treating the textile material may be performed for about 10 to 20 minutes between about 50 degrees Celsius to about 90 degrees Celsius in the same dye bath. After the textile material is treated in step 28, the liquor is drained and refilled again with liquor having MLR maintained between 1:20 to 1:5 in step 30. As will be understood by those of ordinary skill in the art, liquor having a different MLR may also be used as desirable. Thus, the steps 22 to 30 define the dyeing stage 14 which produces the dyed textile product, following which, the post-processing stage 16 is undertaken as described below in the following paragraphs.

The dyed textile product obtained after stages 12 and 14 is subjected to hot wash for about 20 minutes using alkali soap solution at about 60 degrees Celsius to about 90 degrees Celsius at step 32. Once the textile product is hot washed using soap solution, the textile product is subjected to cold wash in step 32. Thereafter, at step 34, bio-polishing using bio-enzymes is performed on the washed textile product. Suitable bio-enzymes such as cellulase on cellulose, lipase on lipids, and protease on protein-based fibers, among other bio-enzymes may be used to perform the bio-polishing on the dyed textile product. After bio-polishing, in step 36, the liquor is drained and cold wash of the bio-polished textile product is performed and the bath is refilled again with liquor having MLR maintained between 1:20 to 1:5.

The textile product is then softened with any known suitable GOTS approved cationic or non-ionic softener preferably at a concentration of about 10 to 15 ml/liter or gm/liter at room temperature for about 20 minutes in step 38. This step helps the textile product to become soft enough for optimal feel. In step 40, the liquor is drained and excessive liquor is extracted. Further, the dyed textile product is then dried above around 50 degrees Celsius to 90 degrees Celsius to obtain the final dyed and processed textile product. Thus, as explained above with reference to steps 32 to 40, the post-processing stage 16 completes the process of preparing the dyed textile product for usage.

The textile product is colored using herbal and natural dyes. These dyes may be obtained from natural sources such as from medicinal plants, many of which have been found to have anti-bacterial and anti-microbial properties. Different parts of the plants can be used in extraction of these dyes. These dyes are not only eco-friendly but also human friendly as they help in improving the body aura or the resistance power, while also maintaining desired pH level of the skin.

The natural textile products produced by the above described dyeing process retain their beneficial natural properties and have antibacterial and antimicrobial properties, while being environment and human friendly. The antibacterial and antimicrobial properties help in activity against bacteria such as *Staphylococcus Aureus* and *Escherichia coli*, etc. Furthermore, these garments and natural textiles products have low carbon footprint.

In comparison with conventional natural dyeing, because of the presence of a lignin substance, a tannin compound naturally present in Neem (*Azadirachta Indica*), the Neem extract helps bind the natural and herbal dyes secure enough to improve the depth and fastness properties of the natural and herbal dyes. The nano-biotechnology application of this property obviates all the limitations attached to natural and herbal dyes. The time consumed for dyeing is shortened considerably from the usual weeks and months process to a few hours. Moreover, the results are also quite uniform. Furthermore, unlike conventional methods of dyeing using natural dyes, the above method helps the dyes penetrate deep enough in the yarns/fabrics/garments and hence fading and bleeding of color is unlikely.

The total time consumed for the entire process described above is not more than four to six hours. Also, the process does not produce any polluting effluents as all material used are natural. Therefore, the residues or effluents from this technology may be utilized as manure. On the other hand, the residues and effluents of synthetic dyeing are very toxic and constitute to be one of the biggest industrial polluters in the world. Further, this process saves a lot of water, electricity, energy, dyeing ingredients and time in comparison to conventional textiles processing methods.

With the help of the described technique and latest technological applications, the results achieved will have greater commercial viability. This is because the products developed have the good features of synthetic dyes such as being economical, having uniformity, sheen, luster, fastness, range etc. while they also retain the eco-friendly and human-friendly properties and the healing and anti-bacterial and antimicrobial properties of Neem (*Azadirachta Indica*) and Holy Basil (*Ocimum Sanctum* or *Tulsi*) of natural dyes. As noted before, micro-encapsulation and coatings of natural aromas and fragrances, herbal extracts, herbal concoctions of various medicinal plants, bio-engineered solutions, and the like may be added in step 24. However, micro-encapsulation and addition of such extracts and solutions may also be performed before or after the dyeing step 26 at a suitable step. For example, this micro-encapsulation and addition of extracts and solutions may be performed before softening the textile product at step 38. Nevertheless, such micro-encapsulation and coating will enhance and induce lasting aesthetic properties in the textile product.

Such organic and natural garments and other natural textile products, with wellness properties, developed from the above techniques can be most effectively used as hospital linen and clothes, super specialty garments for yoga, spas and sports, and, undergarments, kids wear & nightwear etc. to the optimum benefit of consumers without causing any impact on nature.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. A method for dyeing a pre-processed textile product for a desired color, the pre-processed textile product being de-sized, the method comprising:

treating the pre-processed textile product in a dye bath for a first pre-defined period, wherein the step of treating comprises:

preparing a water-based solution maintained with a power of hydrogen (pH) level between 6 and 8 and a Material Liquor Ratio (MLR) in a range of 1:20 to 1:5 at a temperature in a range of 50 degrees Celsius to 90 degrees Celsius;

adding Neem extract in the dye bath in a range of 0.5% to 3% by weight of the pre-processed textile product; and adding holy basil extract in the dye bath in a range of 0.5% to 3% by weight of the pre-processed textile product;

dyeing the treated pre-processed textile product using a natural dye in the dye bath for a second pre-defined period and at a pre-defined temperature; and treating the dyed pre-processed textile product for the first pre-defined period in the dye bath by again adding Neem extract and holy basil extract in the range of 0.5% to 3% by weight of the pre-processed textile product and at a temperature in the range of 50 degrees Celsius to 90 degrees Celsius.

2. The method as recited in claim 1, wherein the de-sized pre-processed textile product is produced by treating a textile product with genetically modified organisms (GMO)-free enzymes.

3. The method as recited in claim 2, wherein the genetically modified organisms (GMO)-free enzymes comprises at least one of amylase, catalase, cutinase, and pectinase.

4. The method as recited in claim 2, wherein the textile product is derived from natural sources comprising any one or a combination of any of organic cotton, cotton, silk, wool, linen, hemp, bamboo, coconut palm, and soya.

5. The method as recited in claim 1, further comprising the step of micro-encapsulating natural aromas and fragrances after the step of treating the pre-processed textile product in the dye bath for the first pre-defined period for inducing aesthetic properties.

6. The method as recited in claim 5, wherein the natural aromas and fragrances comprises at least one of rose fragrance, lavender fragrance, chameli fragrance, jasmine fragrance, and musk fragrance.

7. The method as recited in claim 1, wherein the first pre-defined period is between ten minutes and thirty minutes.

8. The method as recited in claim 1, wherein the range of the second pre-defined period is between ten minutes and thirty minutes.

9. The method as recited in claim 1, wherein the pre-defined temperature is in a range from 50 degrees Celsius to 90 degrees Celsius and is based on the color of the natural dye.

10. The method as recited in claim 1, wherein dyeing the treated pre-processed textile product using the natural dye comprises dyeing using a natural dye obtained from one or more of the roots, stem, bark, leaves, fruits, fruit rind or flowers of at least one of *Acacia catechu, Acacia nilotica Mallotus philippensis, Pterocarpus santalinus, Punica garantum, Quercus infectoria, Rheum emodi, Rubia cardifolia, Rumex maritimus, Terminalia chebula* and *Indigofera tinctoria.*

11. The method as recited in claim 1, wherein dyeing the treated pre-processed textile product using the natural dye comprises dyeing with natural dyes converted into micron-sized and nano-sized particles.

12. The method as recited in claim 1, further comprising:

hot washing the dyed pre-processed textile product using an alkali soap solution at a temperature in a range of 60 degrees Celsius to 90 degrees Celsius for a time period in the range of fifteen minutes to twenty minutes;

cold washing the hot washed dyed pre-processed textile product;

polishing the dyed cold washed pre-processed textile product using GMO-free enzymes comprising cellulase for cellulose, lipase for lipids, and protease for protein-based fibers;

cold washing the polished pre-processed textile product and refilling the dye bath again with liquor having MLR maintained in a range of 1:20 to 1:5;

softening the dyed pre-processed textile product using at least one of a cationic and a non-ionic softener; and drying the dyed pre-processed textile product at a temperature in a range from 60 degrees Celsius to 90 degrees Celsius.

13. A method for dyeing a textile product for a desired color, the method comprising:

de-sizing the textile product;

treating the de-sized textile product in a dye bath for a first pre-defined period, wherein the step of treating comprises:

preparing a water-based solution maintained with a pre-defined power of hydrogen (pH) level and a pre-defined Material Liquor Ratio (MLR) in a range of 1:20 to 1:5 at a temperature in a range of 50 degrees Celsius to 90 degrees Celsius;

adding Neem extract in the dye bath in a range of 0.5% to 3% by weight of the pre-processed textile product; and adding holy basil extract in the dye bath in a range of 0.5% to 3% by weight of the pre-processed textile product;

dyeing the de-sized textile product treated using a natural dye in the dye bath for a second pre-defined period and at a pre-defined temperature; and treating the dyed de-sized textile product for the first pre-defined period in the dye bath by again adding Neem extract and holy basil extract in the range of 0.5% to 3% by weight of the pre-processed textile product and at a temperature in a range of 50 degrees Celsius to 90 degrees Celsius.

14. The method as recited in claim 13, wherein the pre-defined pH level is between 6 and 8 and the pre-defined MLR varies in a range of 1:20 to 1:5.

15. The method as recited in claim 13, wherein de-sizing the textile product is performed using at least one of amylase, catalase, cutinase, or pectinase.

16. The method as recited in claim 13, further comprising micro-encapsulating natural aromas and fragrances after the step of treating the dyed de-sized textile product in the dye bath for the first pre-defined period for inducing aesthetic properties.

17. The method as recited in claim 13, wherein the range of the first pre-defined period is from ten minutes to thirty minutes.

18. The method as recited in claim 13, wherein the range of the second pre-defined period is from ten minutes to thirty minutes.

19. The method as recited in claim 13, wherein the range of the pre-defined temperature is from 50 degrees Celsius to 90 degrees Celsius and is based on the color of the natural dye.

20. The method as recited in claim 13, further comprising:

hot washing the dyed pre-processed textile product using an alkali soap solution at a temperature of 60 degrees Celsius to 90 degrees Celsius for a time period in the range of fifteen minutes to twenty minutes;

cold washing the hot washed dyed textile product;

polishing the dyed cold washed textile product using GMO-free enzymes comprising cellulase for cellulose, lipase for lipids, and protease for protein-based fibers;

cold washing the polished textile product and refilling the dye bath again with liquor having MLR maintained between 1:20 and 1:5;

softening the dyed textile product using at least one of a cationic and a non-ionic softener; and drying the dyed textile product at a temperature in a range of 60 degrees Celsius to 90 degrees Celsius.

* * * * *